US005227593A

United States Patent [19]

Takahashi et al.

[11] Patent Number: 5,227,593

[45] Date of Patent: Jul. 13, 1993

[54] MUFFLER ASSEMBLY FOR ENGINE

[75] Inventors: Kazutoshi Takahashi; Yutaka Kondo, both of Shizuoka, Japan

[73] Assignee: Suzuki Kabushiki Kaisha, Shizuoka, Japan

[21] Appl. No.: 756,597

[22] Filed: Sep. 9, 1991

[30] Foreign Application Priority Data

Sep. 12, 1990 [JP] Japan ..... 2-240062
Sep. 12, 1990 [JP] Japan ..... 2-240063
Sep. 12, 1990 [JP] Japan ..... 2-240064

[51] Int. Cl.[5] ..... F01N 1/00

[52] U.S. Cl. ..... 181/255; 181/269; 181/272; 181/273; 181/276; 181/267

[58] Field of Search ..... 181/249, 250, 251, 255, 181/264, 265, 266, 267, 268, 269, 272, 273, 275, 276, 281, 282

[56] References Cited

U.S. PATENT DOCUMENTS 4,102,430 7/1978 Wilson ..... 181/265
4,487,289 12/1984 Kicinski et al. ..... 181/255 X

*Primary Examiner*—Michael L. Gellner
*Assistant Examiner*—Khanh Dang
*Attorney, Agent, or Firm*—Finnegan, Henderson, Farabow, Garrett & Dunner

[57] ABSTRACT

Muffler assembly for an engine comprises an outer cylinder constituting a muffler body, an inner cylinder coaxially disposed in the outer cylinder, a connection cylinder disposed inside the inner cylinder having one end on an upstream side and another end on a downstream side, a partition plate disposed inside the inner cylinder at the downstream end of the connection cylinder, first and second silencer chambers formed at the upstream and the downstream end of the connection cylinder, respectively, an inlet, pipe through which an engine exhaust gas is introduced into the muffler body, and an outlet pipe having an upstream end disposed inside the inner cylinder and a downstream end opened outward of the muffler assembly. The connection cylinder has an upstream end portion in which a plurality of holes are circumferentially formed. The inlet pipe has a downstream end portion in which a plurality of holes are circumferentially formed so as to flow the exhaust gas passing from the inlet pipe into the first silencer chamber. The upstream end of the outlet pipe is plugged and coaxially inserted into the downstream end of the connection cylinder, the outlet pipe having an upstream end portion in which a plurality of holes are formed. An resonance chamber is formed so as to surround the outlet pipe at the downstream portion thereof.

15 Claims, 3 Drawing Sheets

MUFFLER ASSEMBLY FOR ENGINE

BACKGROUND OF THE INVENTION

The present invention relates to a muffler assembly for an engine unit of a motorcycle, for example, for achieving an improved performance of the muffler assembly.

In general, an engine unit mounted to a motorcycle, particularly is provided with an engine exhaust gas port connected to an exhaust pipe, which is then connected at its rear end to a muffler for discharging the exhaust gas after silencing noise of the exhaust gas in the muffler.

Generally, a muffler device is classified into three types, i e., expansion type, resonance type and reverse type, on the basis of the flow of the exhaust gas in the muffler device. In actuality, however, the muffler device is typically constructed as a combination of these types, as occasion demands.

In order to achieve an improved silencing effect, reduce a back pressure and as well as reduce an output loss, it is necessary for the muffler to have an increased inner volume and an elongated length.

However, for the motorcycle, a cylindrical muffler is conventionally disposed at a side of a rear portion of the motorcycle body. As such, the volume and the length of the conventional muffler are inevitably limited due to the length or size of the motorcycle body, the layout thereof, and the location of other equipments on for the motorcycle.

On the contrary, in order to construct a muffler device having an excellent silencing effect with small volume, the structure of the muffler device is inevitably made complicated.

Particularly, with respect to motorcycles, various requirements in operation or performance criteria including the silencing performance of the muffler device, differ in accordance with geographic locations, country of use and so on. In order to satisfy these different requirements, muffler devices are conventionally manufactured in various sizes, lengths and the like, out of connection pipes, outlet pipes and other elements for the muffler devices. This results in complicated and increased manufacturing processes, as well as increased manufacturing costs. Moreover, these also create more troublesome control and management of the manufacture.

SUMMARY OF THE INVENTION

An object of the present invention is to substantially eliminate defects or drawbacks encountered in the prior art, and to provide a muffler assembly for a motorcycle having a reduced volume and length which is capable of achieving a highly improved silencing performance, a reduced back pressure, and a reduced output loss.

This and other objects can be achieved in various aspects by providing a muffler assembly for an engine of a motorcycle, wherein the muffler assembly comprises an outer cylinder constituting a muffler body, an inner cylinder coaxially disposed in the outer cylinder, a connection cylinder disposed inside the inner cylinder having one end on an upstream side, and another end on a downstream side, a partition plate disposed inside the inner cylinder at the downstream end of the connection cylinder. To achieve the objects, the muffler assembly further includes first and second silencer chambers formed at the upstream end of the connection cylinder and on the downstream side end of the connection cylinder, respectively, an inlet pipe through which an engine exhaust gas is introduced into the muffler body, and an outlet pipe having an upstream end disposed inside the inner cylinder and a downstream end opened outward of the muffler body. The connection cylinder has an upstream end portion in which a plurality of holes are circumferentially formed. The inlet pipe has a downstream end portion in which a plurality of holes are circumferentially formed, so as to permit the flow of the exhaust gas passing from the inlet pipe into the first silencer chamber. The upstream end of the outlet pipe is plugged and coaxially inserted into the downstream end of the connection cylinder, the outlet pipe having an upstream end portion in which a plurality of holes are formed.

In preferred embodiments, of the present invention, a first punched plate through which a plurality of punched holes are formed is disposed in the muffler body between the one end of of the connection cylinder and the upstream end of the inlet pipe, and a second punched plate through which a plurality of punched holes are formed is disposed in the other end portion of the connection cylinder.

A cylinder member is further arranged coaxially so as to surround a downstream portion of the outlet pipe with a space provided as a resonance chamber between the cylinder member and the outer peripheral surface of the outlet pipe. A plurality of perforations are formed through the outer peripheral surface of the outlet pipe at portions corresponding to a location of the resonance chamber, and a sound absorption material is filled into the resonance chamber.

A support plate is further disposed inside the inner cylinder at a portion directly in front of one end of the connection cylinder, the support plate having an outer peripheral portion through which a plurality of holes are formed and a central solid portion having a size sufficient to close the one end of the connection cylinder.

According to the present invention, as presented by of the the elements described above, the engine exhaust gas is introduced circumferentially into the first silencer chamber from the downstream end of the inlet pipe. The back pressure of the exhaust gas can then be reduced even if the downstream end of the inlet pipe is disposed near the connection cylinder, thus reducing the whole length of the muffler assembly, and the exhaust gas can be effectively diffused, thus enhancing the silencing effect.

The upstream end of the outlet pipe is inserted into the downstream end of the connection cylinder, so that the relatively long outlet pipe can be arranged without extending the length of the muffler assembly, thus effectively attenuating pressure pulsation of the exhaust gas. The location of the resonance chamber improves the silencing efficiency.

In the embodiment in which the connection cylinder is provided with a plurality of holes, the exhaust gas once expanded in the first silencer chamber is throttled when passing through the holes and then expanded in the second silencer chamber. The exhaust gas is again throttled when passing through the holes formed in the outlet pipe. The sizes of these holes can be selectively changed by the simple drill working, thus adapting the muffler for the various requirements for the muffler performance.

BRIEF DESCRIPTION OF THE DRAWINGS

For a better understanding of the present invention and to show how the same is carried out, reference is first made, by way of preferred embodiments, to the accompanying drawings, in which.

DESCRIPTION OF THE PREFERRED EMBODIMENTS

Figure 1:
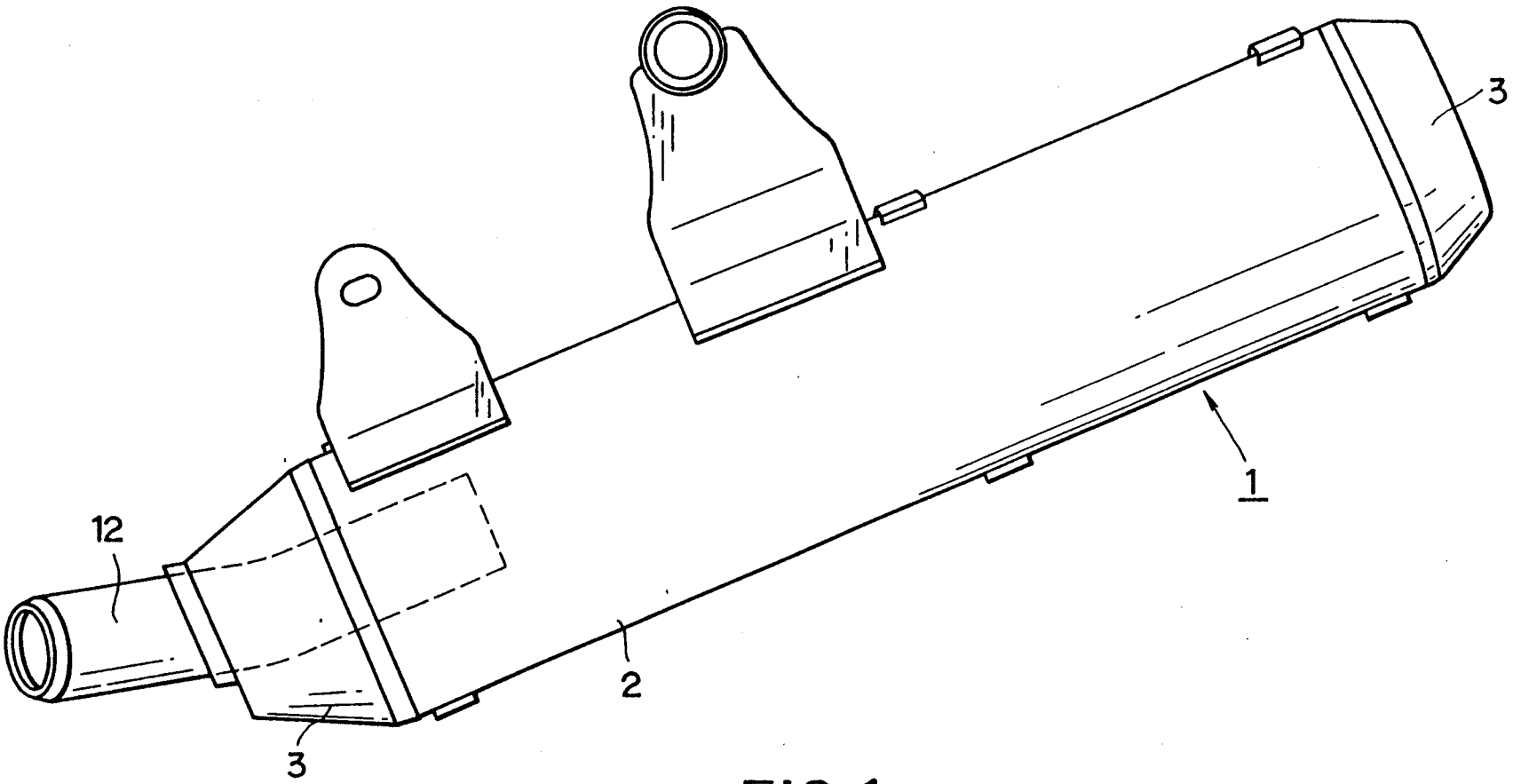
FIG. 1 is a general outer appearance of a muffler assembly according to the present invention.
Figure 2:
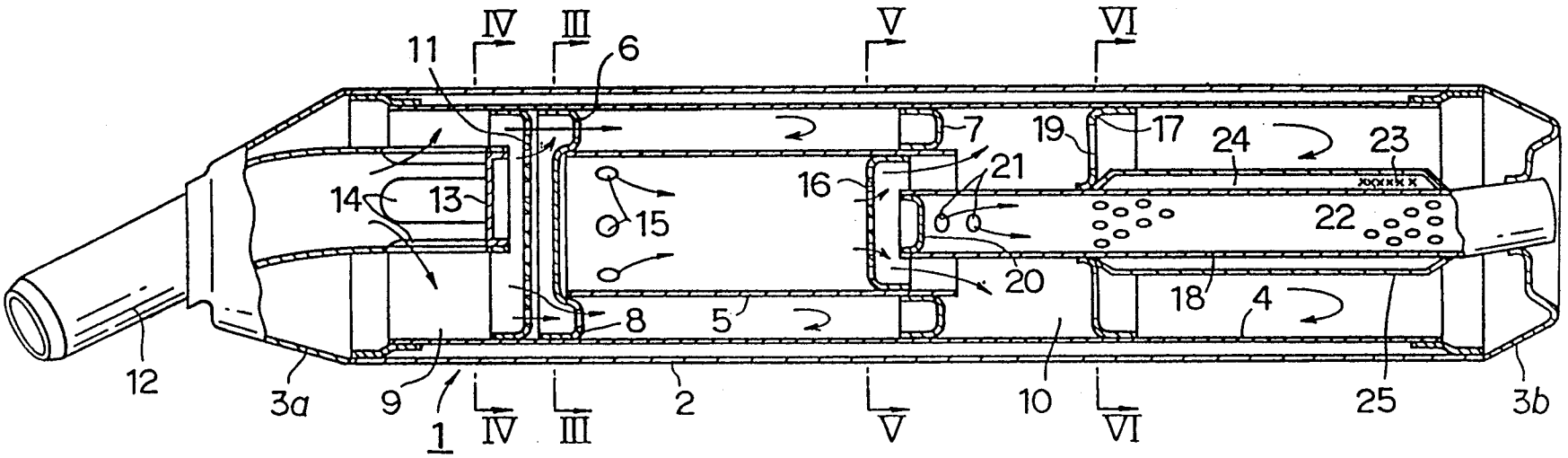
FIG. 2 is a longitudinal sectional view of the muffler assembly of FIG. 1.

FIG. 1 shows an outer appearance of a muffler assembly according to the present invention and FIG. 2 is a longitudinal sectional view thereof. Referring to FIG. 2, the muffler assembly 1 comprises an outer cylinder 2 as a muffler body and an inner cylinder 4 disposed substantially coaxially inside the outer cylinder 2 with a space therebetween. The location of the space is for the purpose of reducing outward radiation of impact or shock noise due to pressure pulsation caused by an exhaust gas from the engine through an exhaust pipe. End plates 3*a* and 3*b* are disposed at front and rear ends of the outer cylinder 2.

In the interior of the inner cylinder 4, is coaxially disposed a connection cylinder 5 at substantially the central portion therein, which is supported by a support plate 6 at its front end and a partition plate 7 at its rear end. The support plate 6 and the partition plate 7 are secured to the inner surface of the inner cylinder 4 by a suitable manner such as welding means.

Figure 3:
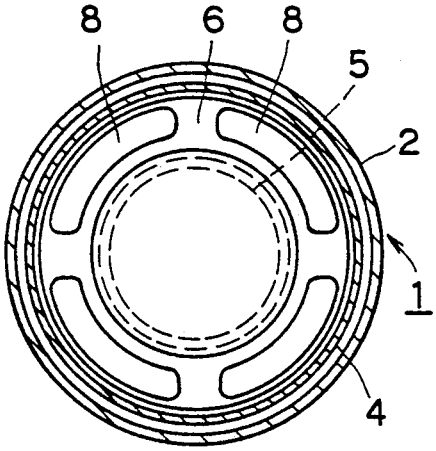
FIGS. 3 to 6 are sectional views taken along the lines III—III, IV—IV, V—V and VI—VI shown in FIG. 2, respectively, for showing inside arrangements of various sections of the muffler assembly of the present invention.
Figure 4:
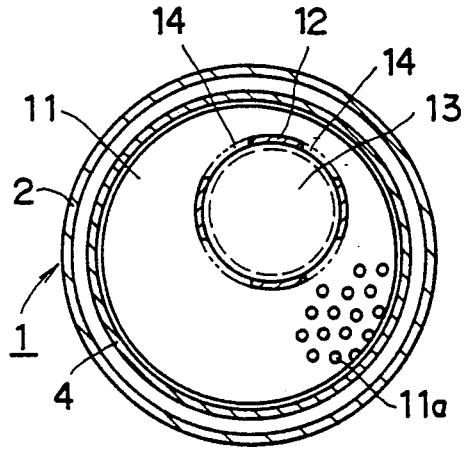

As shown in FIG. 3, the support plate 6 has generally a circular configuration. A plurality of windows 8, four in the illustration of FIG. 3, are formed proximate the outer peripheral portion of the support plate 6, and a central portion of the support plate 6 is positioned to close the front end of the connection cylinder 5. The support plate 6 has a shape, as shown in FIG. 2 as a side sectional view, suitable for closing and supporting the front end of the connection cylinder 5.

The partition plate 7 also has a circular configuration, as shown in cross section in FIG. 2, and has a central hole through which the rear end of the connection cylinder 5 extends in a supported manner. Thus the partition plate 7 also supports the connection cylinder 5. The interior of the muffler body is sectioned into first and second silencer chambers 9 and 10 by the support plate 6 and the partition plate 7. The first silencer chamber 9 is located on the front, upstream, side of the support plate 6 and the second silencer chamber 10 being in the rear, downstream, side of the partition plate 7.

As shown in FIGS. 2 and 3, a punched plate 11 is disposed in the first silencer chamber 9 directly in front of the support plate 6. The punched plate 11 is provided with a plurality of holes 11*a* for facilitating the diffusion of the exhaust gas from the exhaust pipe in the muffler body. An inlet pipe 12 connected to the exhaust pipe is inserted into the front end of the muffler body so that the inserted end of the inlet pipe 12 is disposed in the first silencer chamber 9 near the punched plate 11. The inserted open end of the inlet pipe 12 is closed by a plugging plate 13. A plurality of holes 14, each in the shape of longitudinal slit, are circumferentially formed through the outer peripheral surface, near the inserted end, of the inlet pipe 12; through which the exhaust gas flows circumferentially, as shown by arrows, in an expanded manner.

Figure 5:
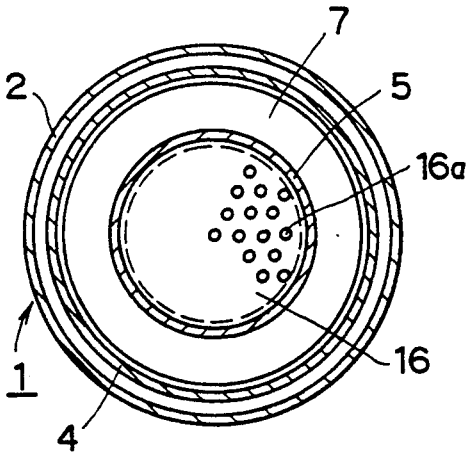

A plurality of holes, each in shape of longitudinal slit, for example, are formed through the outer peripheral surface, near the support plate 6, of the connection cylinder 5. The opened rear end of the connection cylinder 5 is closed by a punched plate 16 provided with a plurality of small holes 16*a*. As shown in FIG. 2, the punched plate 16 is inserted into the opened rear end of the connection cylinder 5 and secured thereto in an arrangement such as that shown in FIG. 5.

Figure 6:
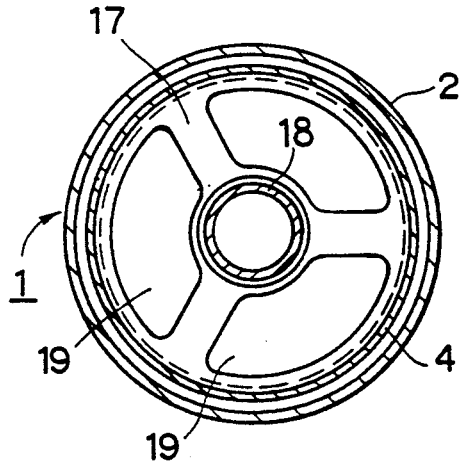

In the second silencer chamber 10, is located an outlet pipe 18 which is supported therein by a support plate 17 and the end plate 3*b*. As shown in FIG. 6, the support plate 17 is provided with a plurality of large windows 19, three for examples, so as not to block the flowing of the exhaust gas in the second silencer chamber 10. The support plate 17 is also provided with a central hole through which the outlet pipe 18 extends in a supported manner. The front end of the outlet pipe 18 extends coaxially in the rear end of the connection cylinder 5 near the punched plate 16 and is closed by a plugging plate 20. A plurality of holes 21 are formed to the front end portion of the outlet pipe 18. A number of small holes 22, i.e., perforations, 22 are formed through the outer peripheral surface of the outlet pipe 18. In the illustrated embodiment, of FIG. 2 a cylindrical member 25 is coaxially disposed around the outer peripheral surface of the rear portion of the outlet pipe 18 so as to form a space between the cylindrical member 25 and the outlet pipe 18 as a resonance chamber 24. The resonance chamber 24 is filled with a sound absorption material such as glass wool 23. The location of the perforations 22 may substantially correspond to the location of the resonance chamber 24. The rear end of the outlet pipe 18 is tightly supported by the end plate 3*b* so that the extremé end of the outlet pipe 18 extends outward of the muffler assembly 1.

The respective holes of the connection cylinder 5 and the outlet pipe 18 are easily formed by drilling working while the holes of the punched plates 11 and 16 are formed easily by punching working.

According to the muffler assembly of the structure described above, the exhaust gas introduced into the inlet pipe 12 from the exhaust pipe, which is connected to the engine exhaust port, is discharged into the first silencer chamber 9 through the holes 14 formed in the rear portion of the inlet pipe, and is then expanded and silenced therein. The exhaust gas then flows downstream and is diffused through the holes 11*a* of the punched plate 11 as shown by arrows. The exhaust gas is thereafter introduced into the connection cylinder 5 through the holes 15 formed in the front end portion thereof, and is then further diffused into the second silencer chamber 10 through the holes 16*a* of the punched plate 16 at the rear portion of the connection cylinder 5. In this manner, the exhaust gas is expanded and silenced in the second silencer chamber 10. The expanded exhaust gas is then introduced into the outlet pipe 18 through the holes 21 formed in the front portion thereof, and exhausted outward of the muffler body through the rear end of the outlet pipe 18 while being subjected to the resonance sound absorption in the resonance chamber 24.

As can be understood from the foregoing, and in accordance with the muffler assembly of the present invention, various types of flows of the exhaust gas can be accomplished as shown by arrows in FIG. 2.

Further, according to the present invention, and as described above, the muffler assembly has a small volume and a short longitudinal length while maintaining improved silencing efficiency. The throttling efficiency for the exhaust gas can be optimumly changed by changing the diameters and/or number of the holes of the connection cylinder and the outlet pipe, for example, and the muffler performance can thus be easily adapted to satisfy the requirements of various places or countries at which a motorcycle may be utilized.

In another aspect, since the rear end of the outlet pipe is inserted into the rear end portion of the connection cylinder, the whole longitudinal length of the outlet pipe can be made long in spite of the relatively short length of the muffler assembly. In this arrangement, the resonance chamber is also formed to thereby effectively attain the silencing effect and to reduce the back pressure and the output loss.

In a further aspect, since the exhaust gas can be diffused circumferentially into the first silencer chamber through the holes formed to the rear end portion of the inlet pipe, the back pressure can be effectively reduced, thus attaining the improved silencing effect.

It is to be understood that the present invention is not limited to the described embodiments and many other changes and modifications may be made without departing from the scope of the appended claims.

What is claimed is:

1. A muffler assembly for an engine comprising:
an outer cylinder member constituting a muffler body;
an inner cylinder member coaxially disposed in the outer cylinder member with a space therebetween;
a connection cylinder member disposed inside the inner cylinder member, the connection cylinder member having an upstream end and a downstream end;
a partition plate disposed inside the inner cylinder member at the downstream end of the connection cylinder member;
a first silencer chamber formed at the upstream end of the connection cylinder member;
a second silencer chamber formed at the downstream end of the connection cylinder member;
an inlet pipe through which engine exhaust gas may be introduced into the muffler body, said inlet pipe having a downstream end plugged and positioned near the upstream end of the connection cylinder member, said inlet pipe having a downstream end portion in which a plurality of holes are formed in a circumferential arrangement to permit the flow of exhaust gas passing from the inlet pipe circumferentially into the first silencer chamber; and
an outlet pipe having an upstream end disposed inside the inner cylinder member and a downstream end opened outward of the muffler body.

2. The muffler assembly according to claim 1, wherein a first punched plate, through which a plurality of punched holes are formed, is disposed in the muffler body between the upstream end of the connection cylinder member and the downstream end of the inlet pipe.

3. The muffler assembly according to claim 2, wherein a second punched plate, through which a plurality of punched holes are formed, is disposed in a downstream end portion of the connection cylinder member.

4. A muffler assembly for an engine comprising:
an outer cylinder member constituting a muffler body;
an inner cylinder member coaxially disposed in the outer cylinder member with a space therebetween;
a connection cylinder member disposed inside the inner cylinder member, the connection cylinder member having an upstream end and a downstream end;
a partition plate disposed inside the inner cylinder member at the downstream end of the connection cylinder member;
a first silencer chamber formed at the upstream end of the connection cylinder member;
a second silencer chamber formed at the downstream end of the connection cylinder member;
an inlet pipe through which engine exhaust gas may be introduced into the muffler body; and
an outlet pipe having an upstream end disposed inside the inner cylinder member and a downstream end opened outward of the muffler body, the upstream end of said outlet pipe being plugged and coaxially inserted into the downstream end of the connection cylinder member, said outlet pipe having an upstream end portion in which a plurality of holes are formed.

5. The muffler assembly according to claim 4, wherein a cylinder member is further arranged coaxially about a downstream end portion of said outlet pipe with a space constituting a resonance chamber between the cylinder member and an outer peripheral surface of the outlet pipe, and wherein a plurality of perforations are formed through the outer peripheral surface of the outlet pipe proximate said resonance chamber.

6. The muffler assembly according to claim 5, wherein a sound absorption material is filled in the resonance chamber.

7. The muffler assembly according to claim 6, wherein the sound absorption material is a glass wool.

8. A muffler assembly for an engine comprising:
an outer cylinder member constituting a muffler body;
an inner cylinder member coaxially disposed in the outer cylinder member with a space therebetween;
a connection cylinder member disposed inside the inner cylinder member, the connection cylinder member having an upstream end and a downstream end, the connection cylinder member further having an upstream end portion in which a plurality of holes are circumferentially formed;
a partition plate disposed inside the inner cylinder member at the downstream end of the connection cylinder member;
a first silencer chamber formed at the upstream end of the connection cylinder member;
a second silencer chamber formed at the downstream end of the connection cylinder member;
an inlet pipe through which engine exhaust gas may be introduced into the muffler body; and
an outlet pipe having an upstream end disposed inside the inner cylinder member and a downstream end opened outward of the muffler body, the upstream end of the outlet pipe being plugged, the outlet pipe having an upstream end portion in which a plurality of holes are formed.

9. The muffler assembly according to claim 8, wherein a support plate is further disposed inside the inner cylinder member directly in front of the upstream end of the connection cylinder member, said support plate having an outer peripheral portion through which a plurality of holes are formed and a central solid portion having a size sufficient for closing the upstream end of the connection cylinder member.

10. A muffler assembly for an engine comprising:

an outer cylinder member constituting a muffler body;

an inner cylinder member coaxially disposed in the outer cylinder member with a space therebetween;

a connection cylinder member disposed inside the inner cylinder member, the connection cylinder member having an upstream end and a downstream end, the connection cylinder member further having an upstream end portion in which a plurality of holes are circumferentially formed;

a partition plate disposed inside the inner cylinder member at the downstream end of the connection cylinder member;

a first silencer chamber formed at the upstream end of the connection cylinder member;

a second silencer chamber formed at the downstream end of the connection cylinder member;

an inlet pipe through which engine exhaust gas may be introduced into the muffler body, said inlet pipe having a downstream end plugged and positioned near the upstream end of the connection cylinder member, said inlet pipe having a downstream end portion in which a plurality of holes are formed in a circumferential arrangement to permit the flow of exhaust gas passing from the inlet pipe circumferentially into the first silencer chamber; and an outlet pipe having an upstream end disposed inside the inner cylinder member and a downstream end opened outward of the muffler body, the upstream end of the outlet pipe being plugged and coaxially inserted into the downstream end of the connection cylinder member, the outlet pipe having an upstream end portion in which a plurality of holes are formed.

11. The muffler assembly according to claim 10, wherein a first punched plate, through which a plurality of punched holes are formed, is disposed in the muffler body between the upstream end of the connection cylinder member and the downstream end of the inlet pipe.

12. The muffler assembly according to claim 11, wherein a second punched plate, through which a plurality of punched holes are formed, is disposed in a downstream end portion of the connection cylinder member.

13. The muffler assembly according to claim 10, wherein a cylinder member is further arranged coaxially about a downstream end portion of said outlet pipe with a space constituting a resonance chamber between the cylinder member and an outer peripheral surface of the outlet pipe, and wherein a plurality of perforations are formed through the outer peripheral surface of the outlet pipe proximate said resonance chamber.

14. The muffler assembly according to claim 13, wherein a sound absorption material is filled in the resonance chamber.

15. The muffler assembly according to claim 10, wherein a support plate is further disposed inside the inner cylinder member directly in front of the upstream end of the connection cylinder member, said support plate having an outer peripheral portion through which a plurality of holes are formed and a central solid portion having a size sufficient for closing the upstream end of the connection cylinder member.

* * * * *